United States Patent [19]

Mazzarella

[11] 4,028,172

[45] June 7, 1977

[54] PROCESS OF MAKING PAPER

[75] Inventor: Emil D. Mazzarella, Mountainside, N.J.

[73] Assignee: National Starch and Chemical Corporation, Bridgewater, N.J.

[22] Filed: Oct. 23, 1975

[21] Appl. No.: 624,732

Related U.S. Application Data

[63] Continuation-in-part of Ser. No. 460,918, April 15, 1974, abandoned.

[52] U.S. Cl. ..... 162/164 R

[51] Int. Cl.[2] ..... D21D 3/00

[58] Field of Search ..... 260/46.5 R; 162/164 R

[56] References Cited

UNITED STATES PATENTS

| | | | |
|---|---|---|---|
| 2,507,200 | 5/1950 | Elliott | 162/164 R |
| 3,046,160 | 7/1962 | Dengler | 162/164 R |
| 3,280,160 | 10/1966 | Bailey | 260/46.5 R |
| 3,395,071 | 7/1968 | Nitzsche et al. | 162/164 R |
| 3,436,252 | 4/1969 | Newroth | 260/46.5 R |
| 3,438,807 | 4/1969 | Pikula | 162/164 R |
| 3,445,418 | 5/1969 | Gibbon et al. | 260/46.5 R |
| 3,481,829 | 12/1969 | Shull et al. | 162/164 R |
| 3,565,845 | 2/1971 | Johnson | 260/45.6 R |
| 3,755,071 | 8/1973 | Bey et al. | 162/164 |

FOREIGN PATENTS OR APPLICATIONS

| | | | |
|---|---|---|---|
| 908,988 | 8/1959 | United Kingdom | 162/164 R |

*Primary Examiner*—Robert L. Lindsay, Jr.
*Assistant Examiner*—Peter F. Kratz
*Attorney, Agent, or Firm*—James & Franklin

[57] ABSTRACT

An improved process for making paper is described which improvement concerns the mitigation or avoidance of a commonly occurring problem in the industry termed "wet press picking" by means of specified polymeric siloxane additives.

4 Claims, No Drawings

PROCESS OF MAKING PAPER

This application is a continuation-in-part of our copending U.S. application, Ser. No. 460,918, filed Apr. 15, 1974 and now abandoned.

This invention relates to an improved process for making paper. More particularly, it relates to a process in which the improvement concerns the mitigation or complete avoidance of "wet press picking " (or buildup on the wet presses) as commonly occurs on industrial paper machines.

When a web is first formed on the wire or otherwise in a papermaking process, it thereafter is threaded over and under or between more than a dozen rolls including press rolls, drying and calendering rolls. As the web approaches the press rolls it contains large amounts of water which previously served to carry the paper fiber for web formation, and considerable amounts of this water are removed by the action of press rolls operating in pairs, a top roll and a cooperative bottom roll. In usual practice, the wet web is carried on a felt through the nip of two or more pairs of press rolls, as well as a pair of rolls commonly referred to as the "smoothing press " which, together with the press rolls, constitutes the wet press section of the paper machine. The web then enters the dryer section of the paper machine immediately following the smoothing rolls.

The web makes direct contact with the upper press rolls and it is at this point that a problem termed "wet press picking" (or buildup on the wet presses) is often developed. The press rolls nearest the headbox are often referred to as "wet" press rolls in the industry. For convenience, the term "press rolls" as used herein will generally designate "wet" press rolls, as well as the smoothing press rolls. The bottom press rolls may be slotted or vacuum equipped for improved dewatering and, as previously indicated, covered by an endless moving felt to absorb water from the web.

The problem of wet press picking is manifested wherein small agglomerates of fibers from the web, with or without pigment or other particles (at times, just barely visible to the naked eye) are picked up from the web and attach themselves to the surface of the press rolls which come in direct contact with the travelling web. The deposited particles in turn create an obstruction on the press roll surface sufficient to detach a small portion of web from the moving web surface, constituting a singular point of wet press picking. The press roll turns at high speeds, and it is understandable that the picking may be repeated at localized areas of the press roll and in many cases the progressive buildup may be serious enough to cover the entire contacting surface of the roll. In extreme cases, the tacky roll surface may cause the moving web to follow and wrap itself around the roll resulting in a web breakage and considerable downtime. Even in less extreme cases, the surface of the paper will be generally gouged or badly disrupted causing serious quality problems.

The main cause or causes of web press picking have not been identified with any certainty. It is known, however, that a number of factors tend to initiate, contribute or aggravate the problem. Among these factors are included: (a) origin and type of pulp with hardwood pulps generally being more susceptible to wet press picking, (b) operating with little stock refining or web moisture outside of a prescribed moisture range, (c) impurities such as residual pulping impurities, pitch, slime or foam in the papermaking furnish (or feed stock), and (d) the inclusion of various additives in the stock slurry prior to sheet formation, particularly high concentrations of rosin or other commercially supplied sizing agents, as well as relatively high concentrations of polymeric binders and other chemical additives.

Various measures have been contemplated by the industry in recent years for dealing with wet press picking. To correct wet press picking according to recent prior art, most often the press roll would be equipped with a doctor blade and/or water shower. Such measures are not fully effective, however, and the use of a water shower also introduces undesired moisture to the web. Use of press rolls of various surface compositions, for example, specially compounded hard or soft rubber, granite or stone, polymer coated or filled plastic surfaces, have also been tried in an attempt to overcome the problem, but none have resolved the problem and no definite conclusions as to the superiority of one composition over another have been reached. Machine grinding of the rolls to effect special surface characteristics have also proven to be unsuccessful. The addition to the feed stock of extra amounts of alum over that ordinarily used has been found to reduce picking at times, but the procedure is not generally reliable and may actually create more picking under certain conditions. Careful control of operating conditions, within limits imposed by specific manufacturing objectives, can alleviate the problem, but not fully eliminate it when it arises. These measures include maximizing fiber refining and retention characteristics in the sheet-forming process, optimization of vacuums, draws and other machine variables, etc. Certain materials including, for example, natural gums, various pitch dispersants, talc, sequestering agents, etc. added to the furnish have provided only modest improvements in some cases. On an industry basis, wet press picking is still a common occurrence and none of the attempts to correct the picking can be said to be fully successful in eliminating the problem.

DESCRIPTION OF THE INVENTION

I have now discovered that wet press picking is substantially mitigated or essentially eliminated when a specified polymeric siloxane is added to the feed stock in a specified concentration range in accordance with the process of this invention. Moreover, the prevention of wet press picking in this manner is independent of the composition of the press roll or its surface characteristics. The process has been found successful in papermaking conditions employing high or, alternatively, low concentrations of alum or sizing agents. The process is not dependent on the source or type of pulp used in the feed stock, the presence of other additives, etc.

The principal object of this invention is to provide an improved process of making paper wherein wet press picking is substantially or completely eliminated so that it no longer presents a problem to the paper maker under normal papermaking conditions.

The principal object of the present invention may be accomplished by reference to the following detailed description.

The polymeric siloxane additives useful in the process of this invention are of two classes: (A) a fluid, water-soluble copolymer of dimethylpolysiloxane-polyoxyalkylene ether wherein the alkylene moiety may be ethylene, propylene or mixtures thereof. Examples of this copolymer available commercially are the products designated "SF-1066" sold by General Electric Company and "L-7001" sold by Union Carbide Corporation, and (B) an aqueous emulsion of dimethylpolysiloxane or self-emulsifying mixture of dimethylpolysiloxane and surfactant. The emulsified dimethylpolysiloxane must remain water dispersible in all proportions. Examples of useful dimethylpolysiloxane emulsions commercially available are the products designated "SM-2061" sold by General Electric Company; "LE-466" sold by Union Carbide Corporation; and "HV-490" sold by Dow Corning Corporation.

As to their actual use, the polymers are preferably diluted with water and thereafter added to the headbox or stock preparation system containing cellulose fibers and other papermaking ingredients to provide an amount ranging from about 0.005 to 0.15%, preferably 0.01 to 0.05% of siloxane polymer based on dry fiber weight. When sizing agents, strength additives, or retention aids are used in the stock, the siloxane polymer may be added in appropriate amounts directly to aqueous dispersions of these materials which, in turn, are subsequently added to the headbox or stock preparation system. The aqueous siloxane dispersions may also be sprayed on the web as it travels over the forming wire. The manner of addition is of no serious consequence, it being necessary only to see that the siloxane polymer is uniformly present in the stock in the required concentration prior to the web entering the press section of the paper machine.

It is to be noted that since these aqueous siloxane dispersions are chemically and electrochemically inert in the stock system and are also added to the paper stock during the "wet end" portion of the paper making operation, most of the siloxane is released in the plant effluent and little, if any, of the siloxane polymer is actually present in or on the final dried paper. Although measurement of such small quantities of polymer is virtually impossible, it is estimated that, at most, approximately one-quarter of the initially charged polymer is present in the paper after the drying is completed.

It is also noted that the addition of the polysiloxane polymer within the specified concentrations does not affect other variables in the papermaking process. Thus, the polymer has no deleterious effects on the properties of the resultant paper, for example, strength, porosity, smoothness, printability, optical properties, and the like, since measurements of these properties show them to be within established statistically variable limits for untreated paper products.

The invention will be more fully illustrated by the examples which follow representing specific embodiments of the invention and is not to be construed as a limitation thereon.

EXAMPLE I

A series of tests were conducted on a Fourdriner paper machine wherein the press section consisted of two main presses followed by a smoothing press, each press consisting of a top and bottom roll. The first press consisted of a straight-through plain press with a standard rubber covered top roll typically used in the industry and the second press was a plain reversing press with a composition ("Microrok") covered top roll, also typically used in the industry. The smoothing press consisted of a straight-through set of rolls with a "Press-Tex" metal surfaced top roll and composition covered ("Micromate" ) bottom roll. The basic papermaking furnish consisted of a very lightly refined mixture of approximately 80% bleached hardwood kraft pulp and 20% bleached softwood kraft pulp.

Additives noted below, commonly used in paper making operations to impart sizing and strength, were added continuously to the stock preparation system and a sheet of paperboard was formed at approximately 123 lbs. per 3,000 sq. ft. basis weight. When equilibrium conditions were reached, two polymeric siloxane additives of this invention (as further identified below) were diluted to 1% solids and added continuously to the stock system in concentrations specified in the following table. Build-up due to picking was ascertained under the indicated conditions on each of the press rolls and noted in descriptive terms: none, slight, moderate, heavy, etc. The finished paper was tested in terms of its physical properties.

Table I

| | | Buildup Noted After Running 15 Min. | | |
|---|---|---|---|---|
| | Stock Conditions | 1st Press | 2nd Press | Smoothing Press |
| (1) | Base sheet - No additives | Moderate | Slight | Slight |
| (2) | 0.6% Alum added | Slight | Slight | Slight |
| (3) | 1% Rosin + 2% Alum added | Moderate | Slight | Moderate |
| (4) | 0.5% Starch added | Moderate | None | Slight |
| (5) | 0.25% Synthetic Size* + 0.25% Alum added | Heavy | Moderate | Heavy |
| (6) | 0.25% Synthetic Size* + .05% caustic added | Very heavy | Heavy | Very heavy |
| (7) | 0.025% Dimethylpolysiloxane/Polyethyleneoxide polypropyleneoxide copolymer (SF-1066) added to stock condition (5) | None | None | None |
| (8) | 0.01% Dimethylpolysiloxane/Polyethyleneoxide polypropyleneoxide copolymer (SF-1066) added to stock condition (5) | None | None | Slight |
| (9) | 0.025% Dimethylpolysiloxane/Polyethyleneoxide polypropyleneoxide copolymer (SF-1066) added to stock condition (6) | Slight | Slight | Slight |
| (10) | 0.025% polydimethylsiloxane emulsion (SM-2061) added to stock conditon (5) | None | None | None |
| (11) | 0.01% polydimethylsiloxane emulsion (SM-2061) added to stock | None | None | Slight |

Table I-continued

| Stock Conditions | Buildup Noted After Running 15 Min. 1st Press | 2nd Press | Smoothing Press |
|---|---|---|---|
| condition (5) | | | |

*alkenyl succinic anhydride

The concentrations of the various ingredients listed in the above table are expressed in terms of percent active ingredient by weight of dry pulp.

The above results clearly illustrate the improved results with respect to wet press picking obtained with the use of two polysiloxane polymers typical of this invention under various conditions contrasted to a number of stock conditions in which no polysiloxane polymer was added.

Subsequent physical testing of all paper produced in terms of strength factors, sizing, porosity, surface characteristics, etc., showed no statistically significant differences due to the addition of the siloxane polymers. In order to illustrate the fact that there were no statistically significant changes in physical property, the water resistance (sizing properties) and Mullen burst strength of the samples produced in Sample 5, 7 and 8 were tested.

Water resistance was measured using the TAPPI standard method T441os-69 wherein the amount of water absorbed by the sheet over a period of two minutes was measured. The values obtained, designated Cobb size values, are shown in grams/sq. meter. Measurements are taken on both the top (felt) and bottom (wire) sides of the paper. In this testing procedure, lower Cobb values indicate higher water resistance.

The Mullen Burst Strength was measured using ASTM testing method D774-67. According to this method a sheet of the paper is clamped between two ring shaped platens, thus leaving an exposed circular surface of paper under which there is an inflatable rubber diaphragm. As air is pumped into this diaphragm it expands and comes into contact with the exposed surface of the paper. Note is made of the pressure in p.s.i., at which the diaphragm caused the paper to burst.

Higher values indicate stronger paper. The values are shown in p.s.i.g.

| Sample | Stock Conditions | Cobb Size (felt/wire) | Mullen Burst Strength |
|---|---|---|---|
| 5 | 0.25% Synthetic size (alkenyl succinic anhydride) + 0.25% alum added | 31/32 | 35.0 |
| 7 | 0.025% Dimethylpolysiloxane/ polyethylene oxide polypropyleneoxide copolymer (SF-1066) added to stock condition (5) | 34/36 | 34.0 |
| 8 | 0.01% Dimethylpolysiloxane/ polyethyleneoxide polypropyleneoxide copolymer (SF-1066) added to stock condition (5) | 31/34 | 35.0 |

Although there were minor variations presented above, they are within the range of experimental error and the limits of the tests and there were no statistically significant variations in water resistance or strength between the samples prepared with the polysiloxane in the stock system and those prepared without the additive. Thus, the fact that in the Cobb size test, higher amounts of siloxane yield apparently poorer water resistance (and is therefore in fact contrary to what would be expected) is considered to be due to the experimental error and imprecise nature of the test.

EXAMPLE II

In order to show that addition of the particular polysiloxanes of the present invention in amounts as high as 0.15% based on the dry film weight have no sizing effects on the final paper, handsheets were prepared and tested as follows.

Sheets were prepared according to TAPPI standards using bleached kraft of 50 lb./3000 sq. ft. basis weight, adjusted to pH 6 with alum. All the sheets contained 0.2% of the alkenyl succinic anhydride synthetic size and 0.03% of a cationic retention aid. Sheets were tested immediately after drying and again after 1 hour cure at 105° C.

In comparing the water resistance of these sheets, use was made of a dye test employing crystals of potassium permanganate and an acid ink penetration test. In the dye test several crystals of potassium permanganate are placed on the upper surface of a swatch of test paper which is then set afloat in distilled water at room temperature. As the water is absorbed into the paper the crystals are moistened and impart a characteristic deep violet color to the paper. The time measured in seconds required for an end-point where three colored spots first appear on the paper surface is noted and is in direct relation to the water resistance since a more water resistant paper will retard the moistening of the permanganate crystals which had been placed upon its upper surface.

The acid ink penetration test is a comparison test wherein a swatch of test paper is floated in a dish of acid ink (pH) 1.5) at 100° F. and the time measured in seconds required for the ink to penetrate through the paper to reach an end-point where about 50% of the paper is colored is noted.

The following table presents data on the various paper sheets which were compared in the described testing procedures.

| | Acid Ink Penetration (Time in Seconds) Uncured | Cured | $KMnO_4$ (Time in Seconds) |
|---|---|---|---|
| Sheets containing no silicone (control) | 65 | 60 | 62 |
| Sheets containing 0.15% dimethylpolysiloxane/ polyethyleneoxide polypropyleneoxide copolymer | 62 | 62 | 66 |

Since the above tests are considered to be valid within a tolerance of ± 10%, it is seen that there are no statistically significant sizing effects apparent from the use of up to 0.15% of the polysiloxanes of the present invention.

Summarizing it is seen the invention provides an improved process for making paper essentially eliminating the problem of wet press picking by use of specified polymeric siloxane additives. Variations may be made in materials, proportions and procedures without departing from the scope of this invention.

What is claimed is:

1. In a process of making paper the improvement which comprises the step of adding to the wet pulp, prior to its entrance into the press section of the paper machine, a polysiloxane polymer selected from the group consisting of (A) a fluid water-soluble copolymer of dimethylpolysiloxane-polyoxyalkylene ether wherein the alkylene moiety is ethylene, propylene or mixtures thereof, and (B) an aqueous emulsion of dimethylpolysiloxane, said emulsion remaining water dispersible in all proportions, in an amount sufficient to provide a concentration of from about 0.005 to 0.15% of active polymer based on dry fiber weight, thereby substantially or completely eliminating the problem of wet press picking.

2. The process of claim 1, wherein said polysiloxane polymer is sprayed onto the wet pulp.

3. The process of claim 1, wherein said polysiloxane polymer is a fluid water-soluble copolymer of dimethylpolysiloxane-polyoxyalkylene ether wherein the alkylene moiety is ethylene, propylene or mixtures thereof.

4. The process of claim 1, wherein said polysiloxane polymer is an aqueous emulsion of dimethylpolysiloxane.

* * * * *